US009650859B2

(12) United States Patent
Zhou

(10) Patent No.: US 9,650,859 B2
(45) Date of Patent: May 16, 2017

(54) SEALING A PORTION OF A WELLBORE

(71) Applicant: Saudi Arabian Oil Company, Dhahran (SA)

(72) Inventor: Shaohua Zhou, Dhahran Hills (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 14/736,577

(22) Filed: Jun. 11, 2015

(65) Prior Publication Data

US 2016/0362958 A1 Dec. 15, 2016

(51) Int. Cl.

| | |
|---|---|
| ***E21B 23/06*** | (2006.01) |
| ***E21B 33/12*** | (2006.01) |
| ***E21B 34/14*** | (2006.01) |
| ***E21B 23/04*** | (2006.01) |
| ***E21B 23/00*** | (2006.01) |
| ***E21B 33/129*** | (2006.01) |
| ***E21B 33/128*** | (2006.01) |
| ***E21B 17/10*** | (2006.01) |
| ***E21B 33/10*** | (2006.01) |

(52) U.S. Cl.

CPC ..... *E21B 33/1285* (2013.01); *E21B 17/10* (2013.01); *E21B 17/1078* (2013.01); *E21B 23/00* (2013.01); *E21B 33/10* (2013.01)

(58) Field of Classification Search

None

See application file for complete search history.

(56) References Cited

U.S. PATENT DOCUMENTS

| | | | |
|---|---|---|---|
| 2,674,199 | A | 4/1954 | Page |
| 2,849,070 | A | 8/1958 | Maly |
| 2,874,783 | A | 2/1959 | Haines |
| 3,126,971 | A | 3/1964 | Kellner et al. |
| 3,209,834 | A | 10/1965 | Essary |
| 3,424,245 | A | 1/1969 | Park |
| 4,388,970 | A | 6/1983 | Setterberg |
| 4,421,446 | A | 12/1983 | Leon |

(Continued)

FOREIGN PATENT DOCUMENTS

| | | | |
|---|---|---|---|
| EP | 0552525 | A1 | 7/1993 |
| WO | WO 02/097234 | A1 | 12/2002 |

(Continued)

OTHER PUBLICATIONS

International Search Report and Written Opinion of the International Searching Authority issued in International Application No. PCT/US2015/060550 on Mar. 14, 2016; 13 pages.

*Primary Examiner* — Matthew R Buck
*Assistant Examiner* — Douglas S Wood
(74) *Attorney, Agent, or Firm* — Fish & Richardson P.C.

(57) ABSTRACT

A downhole tool system includes a base tubular that includes a bore therethrough; a centralizer positioned to ride on the base tubular, the centralizer expandable to contact a wellbore wall and adjust a location of the downhole tool system relative to the wellbore wall based on a first fluid pressure supplied through the bore; and a liner top assembly positioned to ride on the base tubular, the liner top assembly including a wellbore liner and a pack-off element, the pack-off element expandable to at least partially seal a liner top of the wellbore liner to the wellbore wall based on a second fluid pressure supplied through the bore.

18 Claims, 15 Drawing Sheets

(56) References Cited

U.S. PATENT DOCUMENTS

| | | | | |
|---|---|---|---|---|
| 4,479,544 | A | 10/1984 | Callihan et al. | |
| 4,773,489 | A | 9/1988 | Makohl | |
| 4,776,394 | A | 10/1988 | Lynde et al. | |
| 5,120,492 | A | 6/1992 | Guironnet | |
| 5,375,662 | A | 12/1994 | Echols, III | |
| 5,566,762 | A | 10/1996 | Braddick | |
| 5,887,660 | A * | 3/1999 | Yokley | E21B 23/04 166/142 |
| 6,457,519 | B1 | 10/2002 | Buytaert | |
| 6,585,042 | B2 | 7/2003 | Summers | |
| 6,739,398 | B1 | 5/2004 | Yokley et al. | |
| 7,073,583 | B2 | 7/2006 | Anderton | |
| 7,143,848 | B2 | 12/2006 | Armell | |
| 7,225,867 | B2 | 6/2007 | Mackenzie et al. | |
| 7,225,870 | B2 | 6/2007 | Pedersen et al. | |
| 8,393,389 | B2 | 3/2013 | Brisco et al. | |
| 8,393,401 | B2 * | 3/2013 | Yokley | E21B 17/06 166/208 |
| 8,443,882 | B2 | 5/2013 | Barnard et al. | |
| 8,453,724 | B2 | 6/2013 | Zhou | |
| 8,496,052 | B2 * | 7/2013 | Frazier | E21B 33/134 166/124 |
| 8,657,004 | B2 | 2/2014 | Zhou | |
| 8,720,561 | B2 | 5/2014 | Zhou | |
| 8,783,340 | B2 * | 7/2014 | Harms | E21B 23/06 166/125 |
| 8,826,992 | B2 | 9/2014 | Zhou | |
| 8,833,466 | B2 | 9/2014 | Zhou | |
| 8,839,870 | B2 | 9/2014 | Ring | |
| 8,893,778 | B2 | 11/2014 | Zhou | |
| 8,973,661 | B2 | 3/2015 | Zhou | |
| 2003/0173076 | A1 | 9/2003 | Sheiretov | |
| 2006/0042801 | A1 | 3/2006 | Hackworth | |
| 2006/0091618 | A1 | 5/2006 | Rosberg | |
| 2008/0181555 | A1 | 7/2008 | Head | |
| 2010/0252271 | A1 | 10/2010 | Kelley | |
| 2011/0056703 | A1 | 3/2011 | Eriksen | |
| 2011/0147013 | A1 | 6/2011 | Kilgore | |
| 2012/0118571 | A1 | 5/2012 | Zhou | |
| 2012/0205872 | A1 | 8/2012 | Reinhardt et al. | |
| 2012/0241154 | A1 | 9/2012 | Zhou | |
| 2012/0261127 | A1 | 10/2012 | Zhou | |
| 2012/0261138 | A1 | 10/2012 | Zhou | |
| 2013/0068467 | A1 | 3/2013 | Zhou | |
| 2013/0068481 | A1 | 3/2013 | Zhou | |
| 2013/0161004 | A1 | 6/2013 | Zhou | |
| 2013/0161100 | A1 | 6/2013 | Zhou | |
| 2013/0161101 | A1 | 6/2013 | Zhou | |
| 2013/0161102 | A1 | 6/2013 | Zhou | |
| 2013/0180736 | A1 | 7/2013 | Hallundbæk | |
| 2013/0228379 | A1 | 9/2013 | Zhou | |
| 2013/0248179 | A1 | 9/2013 | Yeh | |
| 2013/0264120 | A1 | 10/2013 | Zhou | |
| 2013/0269928 | A1 | 10/2013 | Zhou | |
| 2014/0054047 | A1 | 2/2014 | Zhou | |
| 2014/0116728 | A1 | 5/2014 | Zhou | |
| 2014/0151025 | A1 | 6/2014 | Harms | |
| 2014/0251639 | A1 | 9/2014 | Jewett | |
| 2014/0352970 | A1 | 12/2014 | Kristoffer | |
| 2015/0007980 | A1 | 1/2015 | Frazier | |
| 2015/0021047 | A1 | 1/2015 | Buytaert | |
| 2015/0300101 | A1 | 10/2015 | Parsons | |
| 2015/0369022 | A1 | 12/2015 | Zhou | |
| 2016/0024896 | A1 | 1/2016 | Johnson | |

FOREIGN PATENT DOCUMENTS

| | | |
|---|---|---|
| WO | WO03058022 | 7/2003 |
| WO | WO2006127981 | 11/2006 |
| WO | WO 2012/112825 A2 | 8/2012 |
| WO | WO2012177926 | 12/2012 |
| WO | WO 2013/082376 A1 | 6/2013 |
| WO | WO2014137914 | 9/2014 |

* cited by examiner

SEALING A PORTION OF A WELLBORE

TECHNICAL FIELD

This disclosure relates to sealing a portion of a wellbore and, more particularly, to sealing a portion of a wellbore with a liner hanger system.

BACKGROUND

During a well construction process, an expandable liner can be installed to provide zonal isolation or to isolate zones that experience fluid circulation issues. Sometimes failures of expandable liners, such as a failure to expand, occurs, which then leaves an annulus unisolated or unplugged. In such cases, the unexpanded (and uncemented) liner may impose a challenge to further wellbore operations. For example, without a pressure seal at a top of a liner, then a drilling operation may not be able to restart, particularly if there is severe loss zone that is not effectively isolated. Consequently, drilling operation may lose a considerable length of existing wellbore and sidetrack operations may be required above the unexpanded liner top in order to continue the process of well construction. Further, remedial actions may require to cut and retrieve liner out of the wellbore. This can lead to the loss of rig days or even weeks. Conventional liner hanger systems, however, may not offer any effective remedial option in terms of post equipment failure solution.

SUMMARY

In a general implementation, a downhole tool system includes a base tubular that includes a bore therethrough; a centralizer positioned to ride on the base tubular, the centralizer expandable to contact a wellbore wall and adjust a location of the downhole tool system relative to the wellbore wall based on a first fluid pressure supplied through the bore; and a liner top assembly positioned to ride on the base tubular, the liner top assembly including a wellbore liner and a pack-off element, the pack-off element expandable to at least partially seal a liner top of the wellbore liner to the wellbore wall based on a second fluid pressure supplied through the bore.

In a first aspect combinable with the general implementation, the liner top assembly further includes a wedge positioned to ride on the base tubular and expand the pack-off element to at least partially seal the liner top to the wellbore wall based on the second fluid pressure supplied through the bore.

In a second aspect combinable with any of the previous aspects, the wedge is coupled to the base tubular with at least one pin member.

In a third aspect combinable with any of the previous aspects, the pin member is positioned to release the wedge from the base tubular based on the second fluid pressure supplied through the bore.

In a fourth aspect combinable with any of the previous aspects, the liner top assembly further includes a sliding sleeve positioned within the bore and adjustable, based on the second fluid pressure, to release the pin member and decouple the wedge from the base tubular.

In a fifth aspect combinable with any of the previous aspects, the liner top assembly further includes a biasing member positioned to abut the wedge and drive the wedge to expand the pack-off element to at least partially seal the liner top to the wellbore wall based on the second fluid pressure supplied through the bore.

In a sixth aspect combinable with any of the previous aspects, the centralizer includes an inner sleeve positioned within the bore and adjustable, based on the first fluid pressure, to expose a fluid inlet to the bore.

In a seventh aspect combinable with any of the previous aspects, the centralizer further includes a fluidly expandable member in fluid communication with the fluid inlet to expand based on the first fluid pressure communicated through the fluid inlet.

In an eighth aspect combinable with any of the previous aspects, the centralizer further includes a bearing surface coupled with the fluidly expandable member to engage the wellbore wall based on the first fluid pressure.

In a ninth aspect combinable with any of the previous aspects, the centralizer further includes a first seat to receive a member circulated through the bore to expose the centralizer to the first fluid pressure.

In a tenth aspect combinable with any of the previous aspects, the liner hanger assembly further includes a second seat to receive the member circulated through the bore to expose the liner top assembly to the second fluid pressure.

In an eleventh aspect combinable with any of the previous aspects, the first and second fluid pressures include different magnitudes.

In a twelfth aspect combinable with any of the previous aspects, the wellbore wall includes a wellbore casing.

In another general implementation, a method for sealing a liner top to a wellbore wall includes circulating a fluid through a bore of a tubular positioned in a wellbore; circulating the fluid at a first fluid pressure to a centralizer positioned on the tubular; expanding, with the fluid at the first fluid pressure, the centralizer expandable to contact a wellbore wall of the wellbore to adjust a location of the tubular relative to the wellbore wall; adjusting the fluid to a second fluid pressure in the wellbore; expanding, with the fluid at the second fluid pressure, a pack-off element of a liner top assembly positioned on the base tubular to engage the wellbore wall; and sealing a wellbore liner top to the wellbore wall with the expanded pack-off element.

A first aspect combinable with the general implementation further includes subsequent to sealing the wellbore liner top to the wellbore wall with the expanded pack-off element, removing the tubular with the centralizer and the liner top assembly from the wellbore.

In a second aspect combinable with any of the previous aspects, expanding the centralizer includes adjusting a sleeve of the centralizer that is positioned within the bore to expose a fluid path to the bore; exposing an expandable member to the first fluid pressure in the fluid path; radially expanding the expandable member with the first fluid pressure; adjusting, with the expanded member, a bearing surface of the centralizer to contact the wellbore wall; and adjusting the location of the tubular relative to the wellbore wall.

In a third aspect combinable with any of the previous aspects, circulating the fluid at the first fluid pressure includes receiving a ball dropped through the wellbore at a seat of the sleeve of the centralizer to create a fluid seal at the seat of the sleeve of the centralizer; and adjusting a pressure of the fluid uphole of the ball to the first fluid pressure.

In a fourth aspect combinable with any of the previous aspects, adjusting the fluid to the second fluid pressure in the wellbore includes receiving the ball dropped through the wellbore at a seat of a sleeve of the pack-off element to create a fluid seal at the seat of the sleeve of the pack-off element; and adjusting the pressure of the fluid uphole of the ball to the second fluid pressure.

In a fifth aspect combinable with any of the previous aspects, expanding the pack-off element includes releasing, with the fluid at the second fluid pressure, a wedge positioned on the tubular adjacent the pack-off element from the tubular.

In a sixth aspect combinable with any of the previous aspects, releasing the wedge includes adjusting the sleeve of the pack-off element with the second fluid pressure to release a pin member that couples the wedge to the tubular.

A seventh aspect combinable with any of the previous aspects further includes urging the released wedge toward the pack-off element to expand the pack-off element to at least partially seal the wellbore liner top to the wellbore wall with the pack-off element.

In an eighth aspect combinable with any of the previous aspects, the first and second fluid pressures include different magnitudes.

In a ninth aspect combinable with any of the previous aspects, the wellbore wall includes a wellbore casing.

Implementations of a liner top system according to the present disclosure may include one or more of the following features. For example, the liner top system may provide for a simple and robust tool design as compared to conventional top packer used to provide a seal. Further, the liner top system according to the present disclosure may offer a quick installation of a liner top pack-off element as compared to conventional systems. As another example, the liner top system may eliminate a liner hanger and a top packer for non-reservoir sections of the wellbore, thereby decreasing well equipment cost. Further, the described implementations of the liner top system may more effectively operate, as compared to conventional systems, in deviated or horizontal wells in which a liner weight is typically supported by a wellbore due to gravity. As yet another example, the liner top system may mitigate potential rig non-productive time and save well cost as, for example, a complimentary tool string to either an expandable line system or a regular tight clearance drilling liner system. In addition the liner top system may be utilized to provide a cost effective solution to fix a production packer leak by installing a pack-off element at the top of tie-back or polish bore receptacle.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
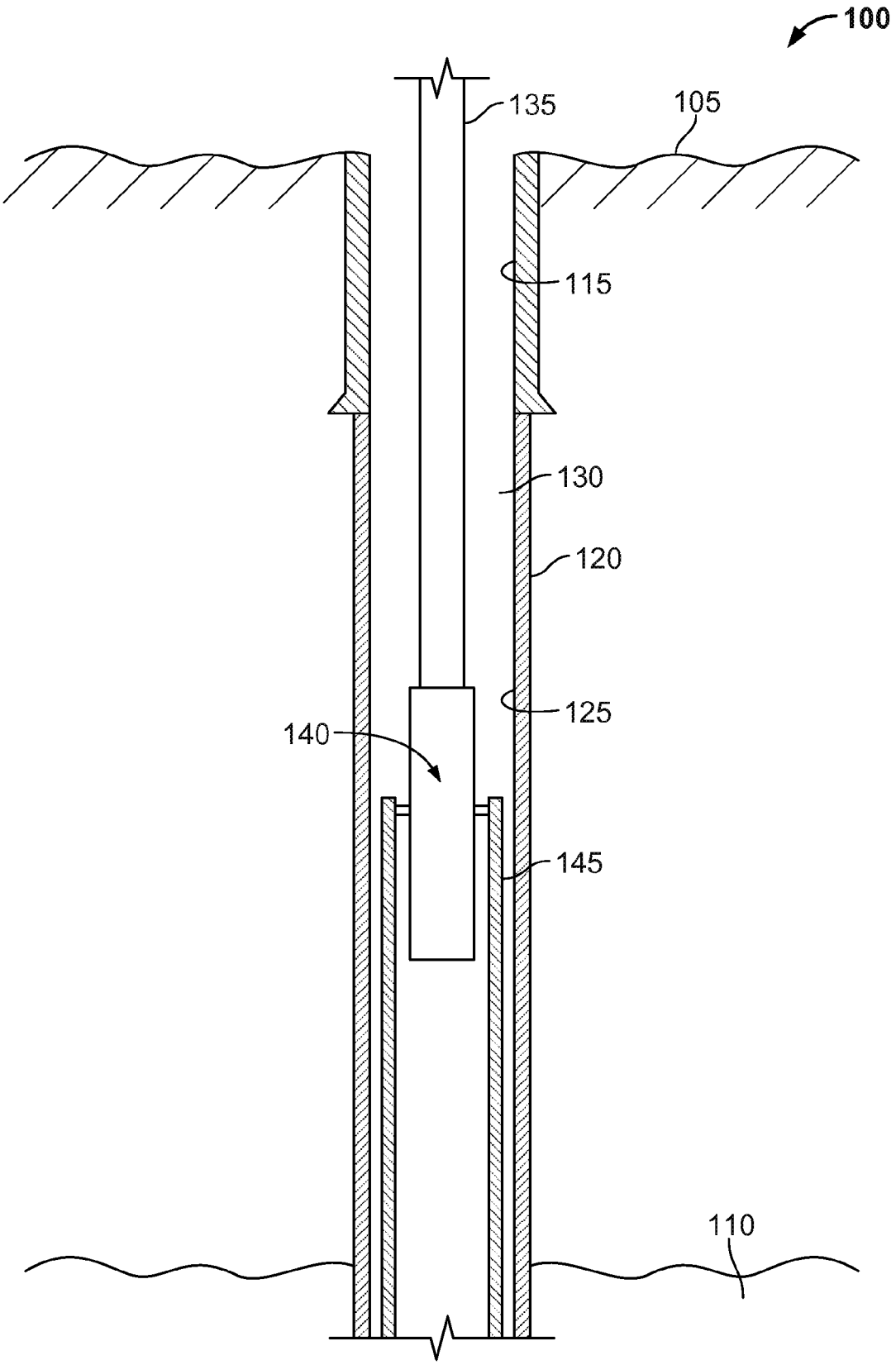
FIG. 1 is a schematic diagram of an example wellbore system that includes a liner top system.

FIG. 1 is a schematic diagram of an example wellbore system 100 that includes a liner top system 140. Generally, FIG. 1 illustrates a portion of one embodiment of a wellbore system 100 according to the present disclosure in which the liner top system 140 may be run into a wellbore 120 to install a liner 145 adjacent a casing 125 (for example, a production or other casing type). In some aspects, the liner top system 140 may also centralize the liner 145 prior to installation, as well as install a sealing member (for example, a packer, liner top packer, or pack-off element) at a top of the liner 145.

In some aspects, the liner 145 is a bare casing joint, which may replace a conventional liner hanger system (for example, that includes a liner hanger with slips, liner top packer and tie-back or polish bore receptacle). For example, in cases in which the wellbore 120 is a deviated or horizontal hole section, a weight of the liner may be supported by the wellbore 120 (for example, due to gravity and a wellbore frictional force), thus eliminating or partially eliminating the need for liner hanger slips. Thus, while wellbore system 100 may include a conventional liner running tool that engages and carries the liner weight into the wellbore 120 in addition to the illustrated liner top system 140, FIG. 1 does not show this conventional liner running tool.

As shown, the wellbore system 100 accesses a subterranean formations 110, and provides access to hydrocarbons located in such subterranean formation 110. In an example implementation of system 100, the system 100 may be used for a drilling operation to form the wellbore 120. In another example implementation of system 100, the system 100 may be used for a completion operation to install the liner 145 after the wellbore 120 has been completed. The subterranean zone 110 is located under a terranean surface 105. As illustrated, one or more wellbore casings, such as a surface (or conductor) casing 115 and an intermediate (or production) casing 125, may be installed in at least a portion of the wellbore 120.

Although illustrated in this example on a terranean surface 105 that is above sea level (or above a level of another body of water), the system 100 may be deployed on a body of water rather than the terranean surface 105. For instance, in some embodiments, the terranean surface 105 may be an ocean, gulf, sea, or any other body of water under which hydrocarbon-bearing formations may be found. In short, reference to the terranean surface 105 includes both land and water surfaces and contemplates forming and developing one or more wellbore systems 100 from either or both locations.

In this example, the wellbore 120 is shown as a vertical wellbore. The present disclosure, however, contemplates that the wellbore 120 may be vertical, deviated, lateral, horizontal, or any combination thereof. Thus, reference to a "wellbore," can include bore holes that extend through the terranean surface and one or more subterranean zones in any direction.

The liner top system 140, as shown in this example, is positioned in the wellbore 120 on a tool string 205 (also shown in FIGS. 2A-2E). The tool string 205 is formed from tubular sections that are coupled (for example, threadingly) to form the string 205 that is connected to the liner top system 140. The tool string 205 may be lowered into the wellbore 120 (for example, tripped into the hole) and raised out of the wellbore 120 (for example, tripped out of the hole)

as required during a liner top operation or otherwise. Generally, the tool string 205 includes a bore therethrough (shown in more detail in FIGS. 2A-2E) through which a fluid may be circulated to assist in or perform operations associated with the liner top system 140.

Figure 2A:
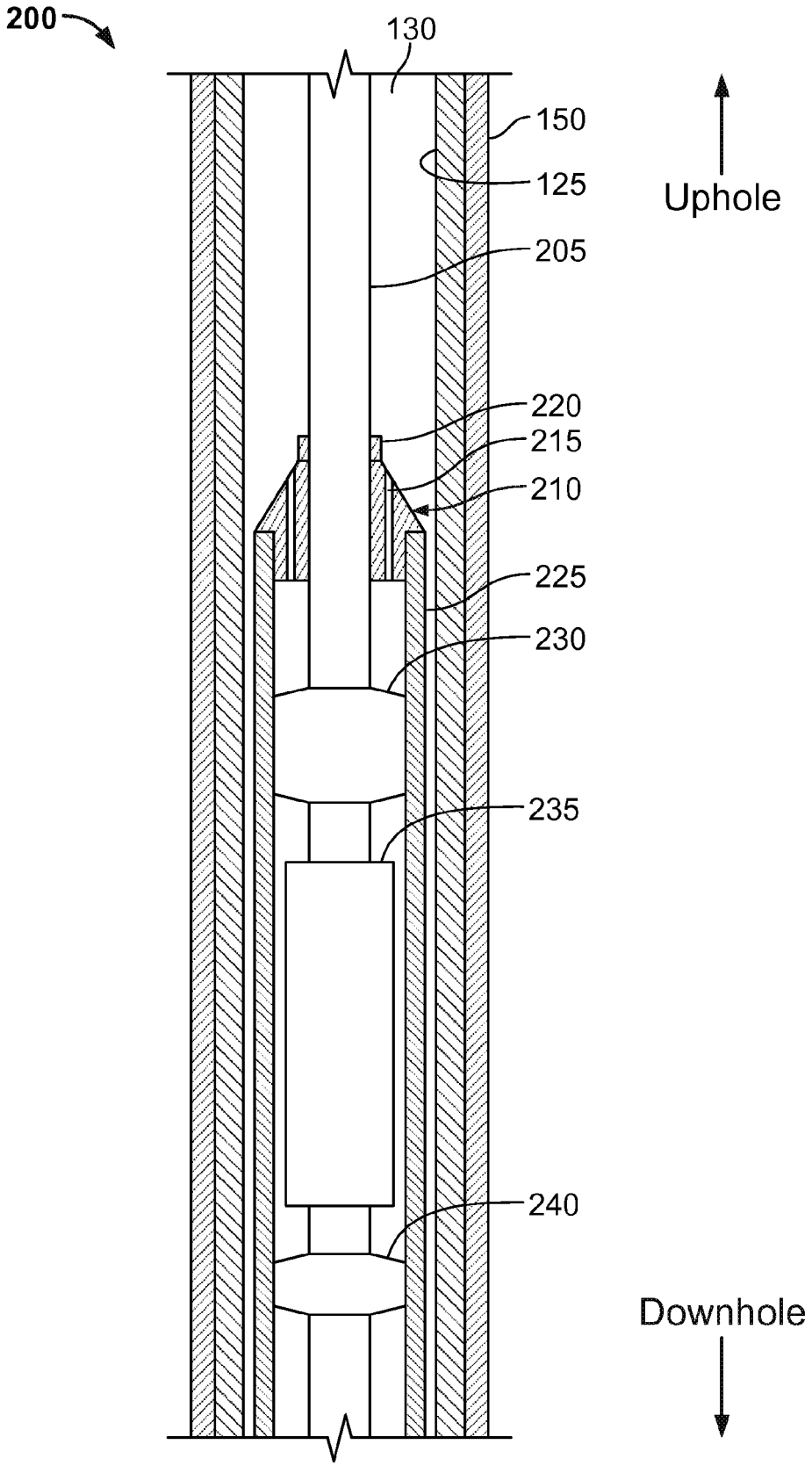
FIGS. 2A-2E are schematic diagrams that show an operation of an example implementation of a liner top system that includes an expandable centralizer and an expandable pack-off element.

FIGS. 2A-2E are schematic diagrams that show an operation of an example implementation of a liner top system 200 that includes an expandable centralizer 230 and an expandable pack-off element 235. In some implementations, the liner top system 200 may be used as liner top system 140 in the well system 100 shown in FIG. 1. As illustrated in FIG. 2A, the liner top system 200 is positioned on the tool string 205 in the wellbore that includes casing 125 cemented (with cement 150) to form an annulus 130 between the casing 125 and the tool string 205.

In this example implementation, the liner top system 200 includes a debris cover 210 that rides on the tool string 205 and includes one or more fluid bypass 215 that are axially formed through the cover 210. The debris cover 210 includes, in this example, a cap 220 that is coupled to cover 210 and seals or helps seal the debris cover 210 to the tool string 205. In example aspects, the debris cover 210 may prevent or reduce debris (for example, filings, pieces of rock, and otherwise) within a wellbore fluid from interfering with operation of the liner top system 200.

As shown, a liner top 225 is coupled to a portion of the debris cover 210 and extends within the wellbore 120 toward a downhole end of the wellbore 120. Positioned radially between the liner top 225 and the tool string 205, in FIG. 2A, are a centralizer 230, an expandable element 235, and a stabilizer 240. FIG. 2A shows the liner top system 200 in a ready position in the wellbore 120, prior to an operation with the liner top system 200. For example, FIG. 2A shows the liner top system 200 positioned in the wellbore subsequent to an operation to cement (with cement 150) the casing 125 in place.

Figure 2B:
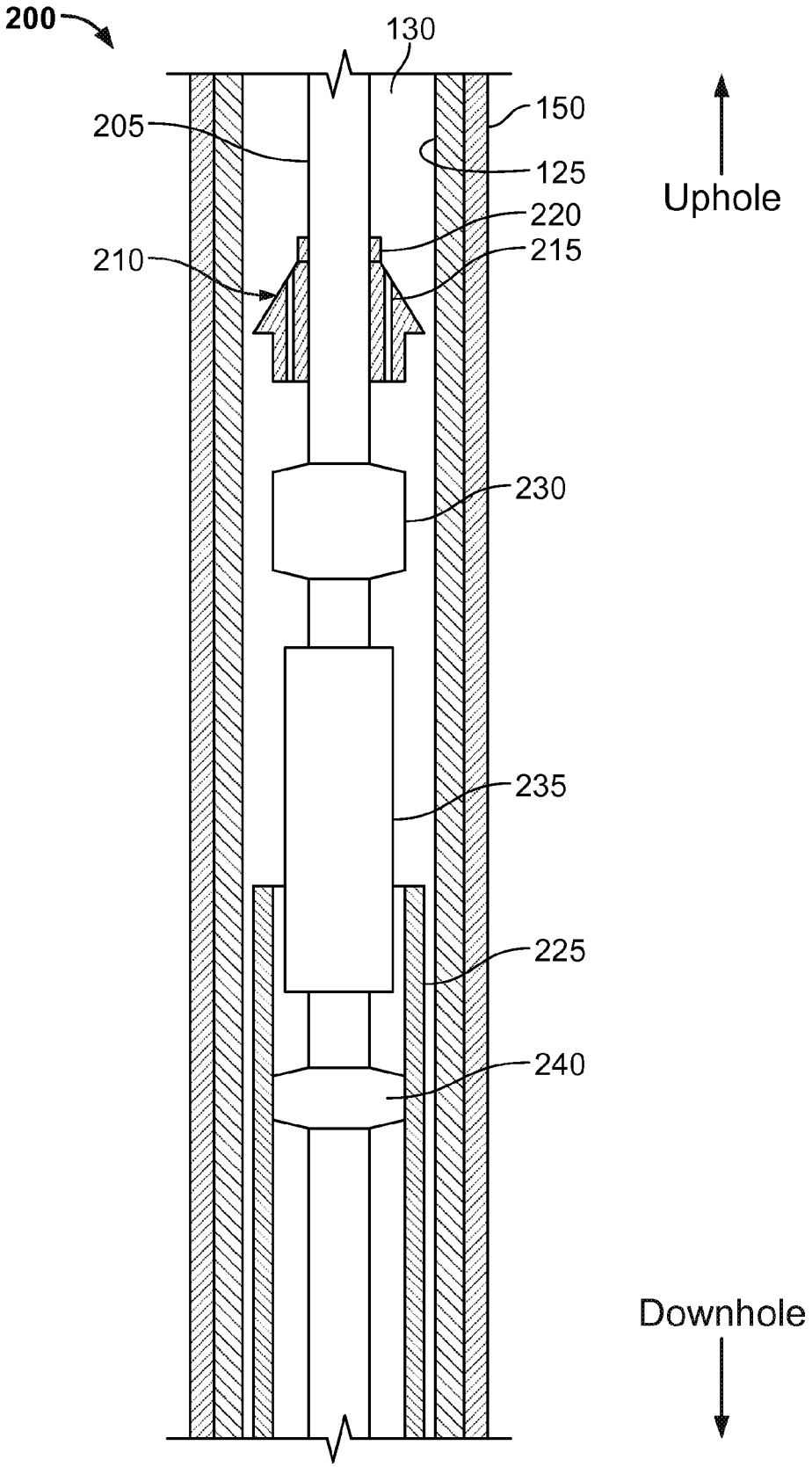

FIG. 2B illustrates the liner top system 200 as an operation to secure the liner top 225 to the casing 125 begins. As shown in this example, the liner top 225 is separated from the debris cover 210 and moved relatively downhole of, for example, the centralizer 230 and the expandable element 225. For instance, as shown in FIG. 2B, the liner top 225 may be moved downhole relatively by moving (for example, pulling) the tool string 205 uphole toward a terranean surface, thereby moving the centralizer 230 and expandable element 235 toward the surface and away from the liner top 225.

Figure 2C:
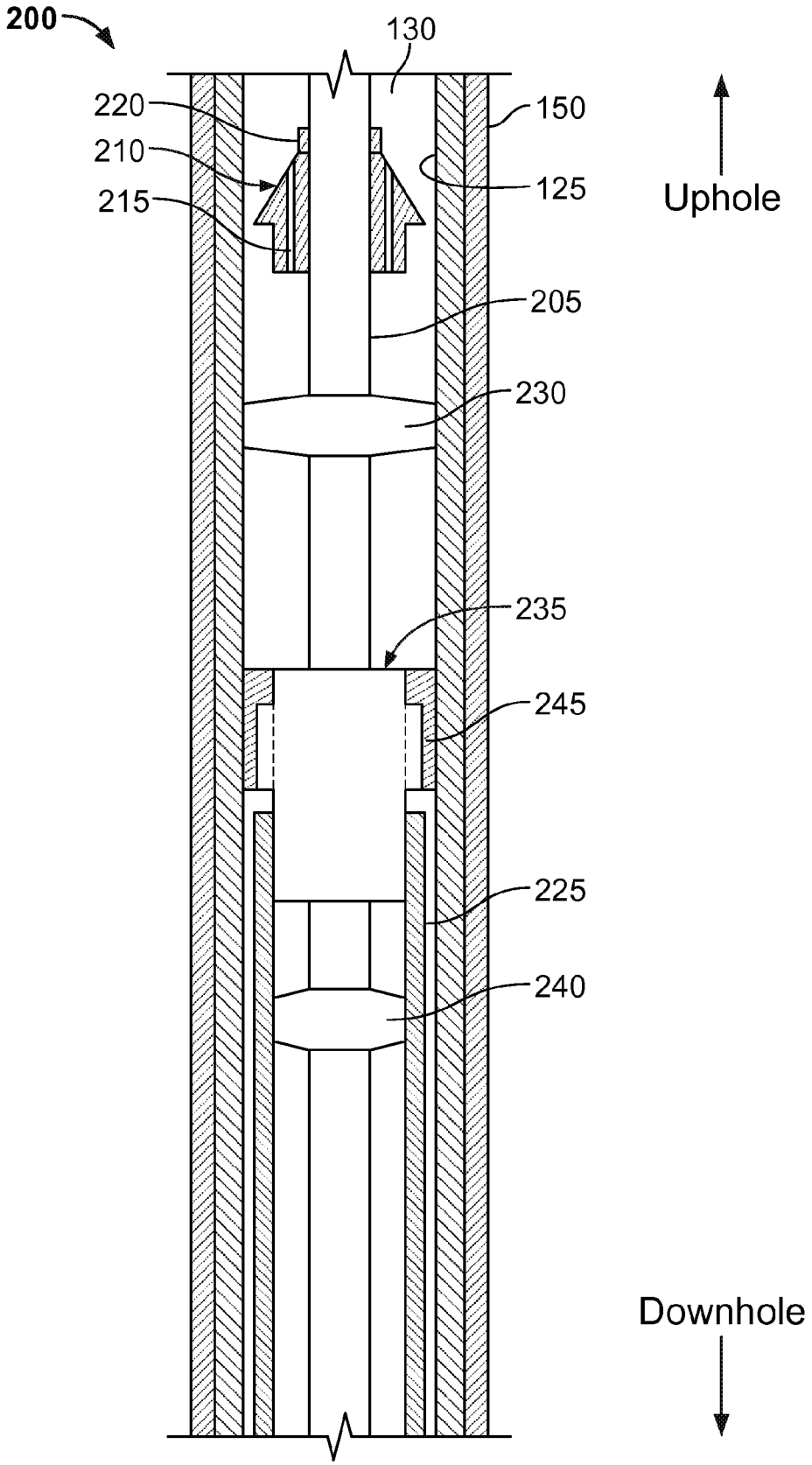

FIG. 2C illustrates a next step of the liner top system 200 in operation. As shown in FIG. 2C, the centralizer 230 is expanded (for example, fluidly, mechanically, or a combination thereof) to radially contact the casing 125. With radially contact, the centralizer 230 adjusts the tool string 205 in the wellbore 120 so that a base pipe of the tool string is radially centered with respect to the casing 125. For example, in a deviated, directional, or non-vertical wellbore 125, the centralizer 230 that is expanded to engage the casing 125 may ensure or help ensure that the tool string 205 correctly performs the liner top operations (for example, by ensuring that the expandable element 235 is radially centered).

As further shown in FIG. 2C, at least a portion of the expandable element 235 is also expanded (for example, fluidly, mechanically, or a combination thereof) to contact the casing 125. In this figure, for instance, a pack-off seal 245 of the expandable element 235 is expanded radially from the element 245 to engage the casing 125.

Figure 2D:
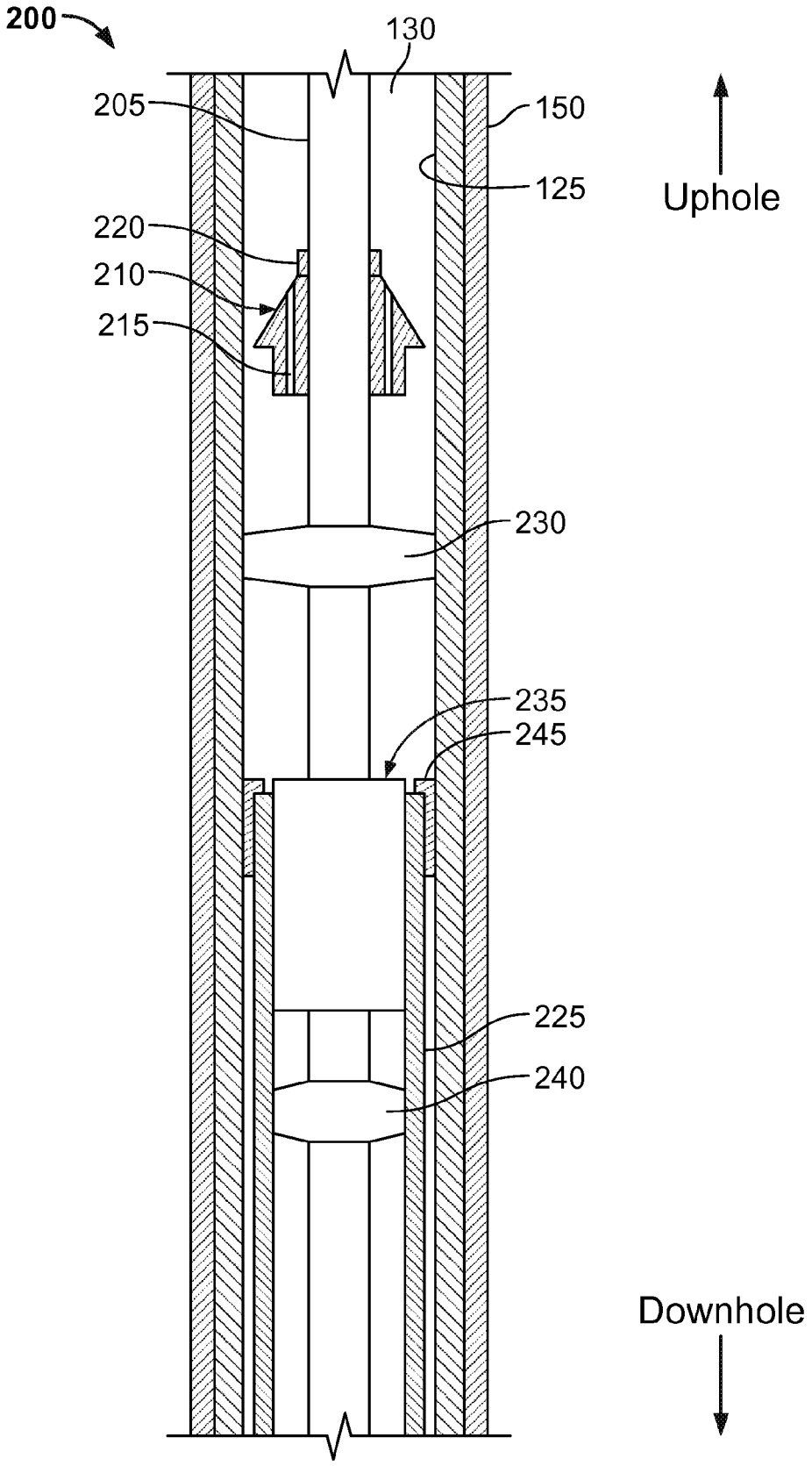

FIG. 2D illustrates a next step of the liner top system 200 in operation. As shown in this figure, the pack-off seal is separated (for example, sheared) from the expandable element 235 to remain in contact with casing 125. During or subsequent to the separation of the pack-off seal 245 from the expandable element 235, the tool string 205 may be adjusted so as to move the liner top 225 into position between the pack-off seal 245 and the expandable element 235. For example, the tool string 205 may be moved downhole so that the liner top 225 is positioned in place to contact and engage the pack-off seal. As shown in FIG. 2D, the pack-off seal 245 seals between a top of the liner 225 (at an uphole end of the liner 225) and the casing 125.

Figure 2E:
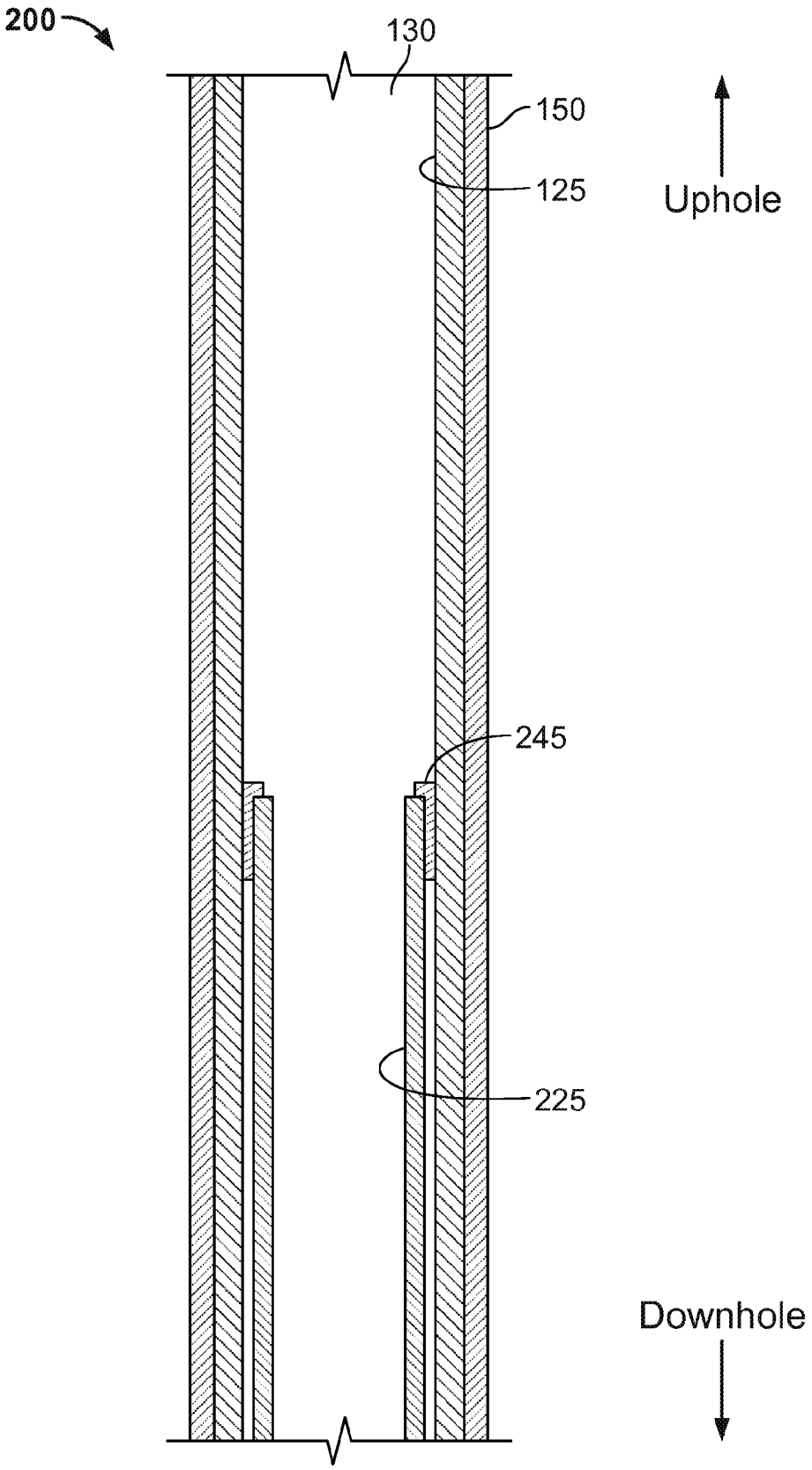

FIG. 2D illustrates a next step of the liner top system 200 in operation. In this illustration, once the liner top 225 has engaged the pack-off seal 245, the tool string 205 may be removed from the wellbore 120. As shown in FIG. 2E, for instance, a full bore of the liner 225 (and casing 125 above the liner 225) may then be used for fluid production (for example, hydrocarbon production) as well as fluid injection, as well as for running additional tool strings into the wellbore 120.

Figure 3A:
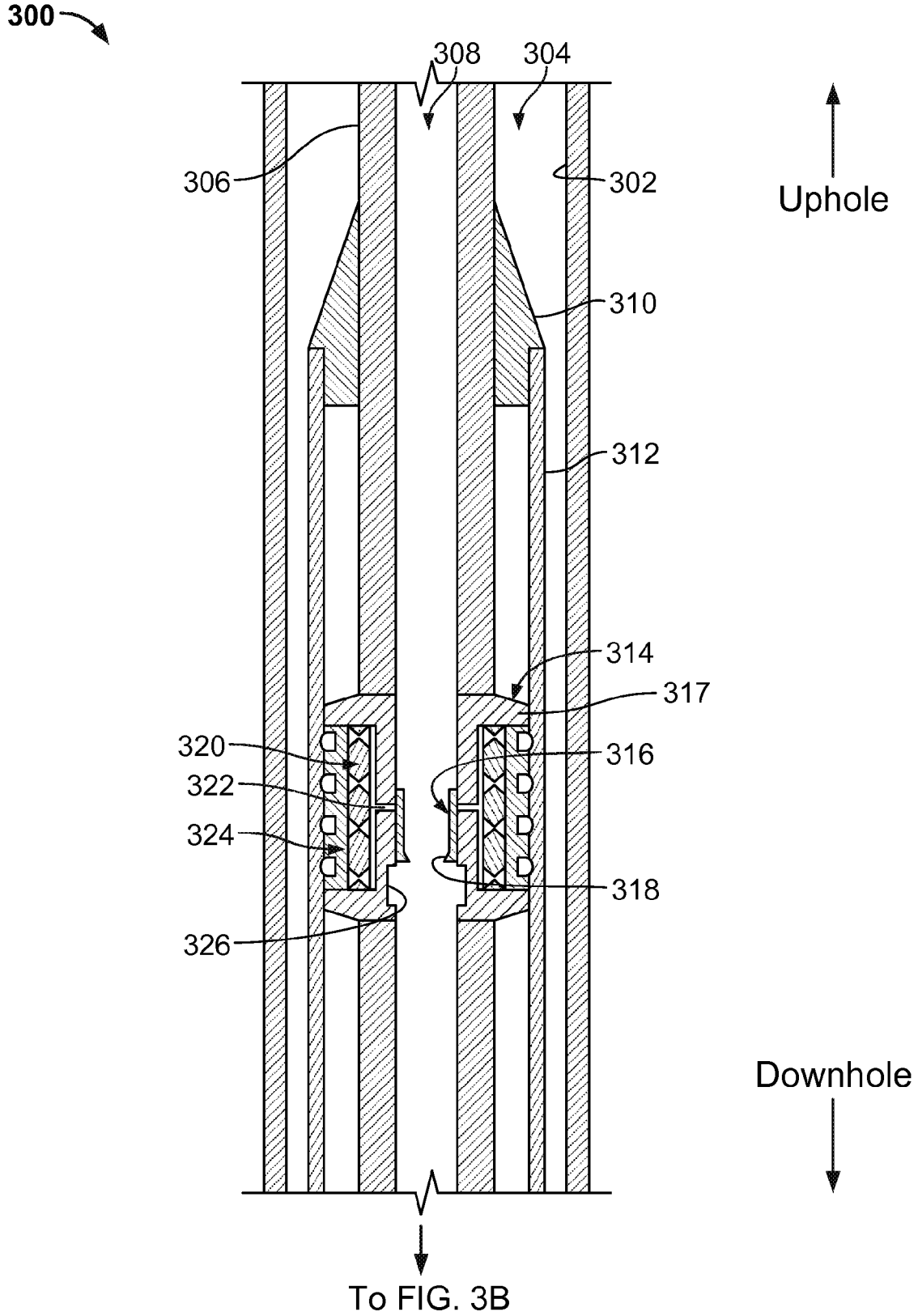
FIGS. 3A-3B are schematic diagrams that show another example implementation of a liner top system that includes an expandable centralizer and an expandable pack-off element.
Figure 3B:
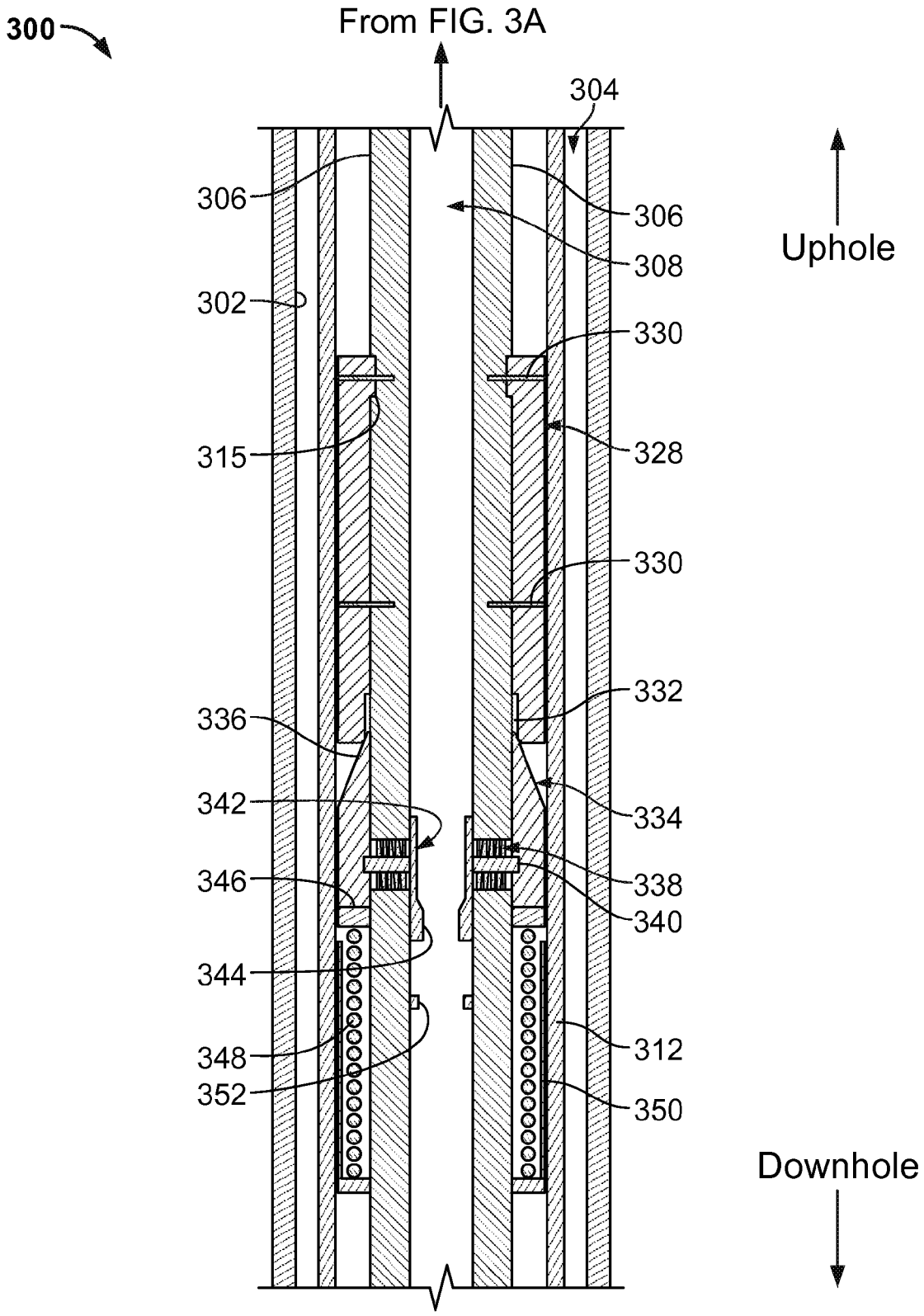

FIGS. 3A-3B are schematic diagrams that show another example implementation of a liner top system 300 that includes an expandable centralizer 314 and an expandable pack-off element 328. As shown in FIG. 3A, the liner top system 300 includes a base pipe 306 in position in a wellbore that includes (in this example) a casing 302. A radial volume of the wellbore between the base pipe 306 and the casing 302 includes an annulus 304. The base pipe 306 includes a bore 308 therethrough.

A top, or uphole, portion of the liner top system 300 is shown in FIG. 3A. The example liner top system 300 includes a cover 310 that is secured to, or rides, the base pipe 306. A liner 312 is, at least initially, coupled to the cover 310 and the cover 310 seals against entry of particles between the liner 312 and the base pipe 306 as shown in FIG. 3A.

Positioned downhole of the cover 310 and also riding or secured to the base pipe 306 is the centralizer 314. In this example embodiment, the centralizer 314 includes a housing 317 that rides on the base tubing 306.

In this example, the centralizer 314 is radially expandable from the base pipe 306 and includes a sliding sleeve 316 that is moveable to cover or expose one or more fluid inlets 322 to the bore 308 of the base pipe 306. In this example, the sliding sleeve 316 includes a narrowed diameter seat 318 at a downhole end of the sleeve 316.

The centralizer 314 also includes an expandable disk assembly 320 that is radially positioned within the centralizer 314 and is expandable by, for example, an increase in fluid pressure in the bore 308. The centralizer 314 further includes a radial bearing surface 324 (for example, rollers, ball bearings, skates, or other low friction surface) that forms at least a portion of an outer radial surface of the centralizer 314. As shown in this example, the bearing surface 324 is positioned radially about the expandable disk assembly 320 in the centralizer 314.

In this example, the centralizer 314 also includes a recess 326 that forms a larger diameter portion of the centralizer 314 relative to the sliding sleeve 316. As shown here, in an initial position, the sliding sleeve 316 is located uphole of the recess 326 and covering the fluid inlets 322.

FIG. 3B illustrates a downhole portion of the liner top system 300. As shown, the liner 312 extends downward (in this position of the system 300) past the pack-off element 328 that is detachably coupled to the base pipe 306. As illustrated in this example, the pack-off element 328 is coupled to the base pipe 306 with one or more retaining pins 330. The illustrated pack-off element 328 also includes a radially gap 332 that separates the element 328 from the base pipe 306 at a downhole end of the element 328. The pack-off element 328 also includes a radial shoulder 315 near an uphole end of the element 328 that couples the element 328 to the base pipe 306.

The liner top system 300 also includes a wedge 334 that rides on the base pipe 306 and is positioned downhole of the pack-off element 328. The wedge 334, in this example, includes a ramp 336 toward an uphole end of the wedge 334 and a shoulder 346 at a downhole end of the wedge 334. As shown in the position of FIG. 3B, the wedge 334 is coupled to the base pipe 306 with one or more locking pins 340. The locking pins 340 are positioned in engaging contact with biasing members 338, which, in the illustrated position of FIG. 3B, are recessed in the base pipe 306.

The liner top system 300 also includes an inner sleeve 342 positioned within the bore 308 of the base pipe 306. In an initial position, the inner sleeve 342 is positioned radially adjacent the biasing members 338 to constrain the retaining pins 340 in place in coupling engagement with the wedge 334. As shown in FIG. 3B, the inner sleeve 342 includes a seat 344 in a downhole portion of the sleeve 342. A diameter of the seat 344, relative to a diameter of the sleeve 342, is smaller in this example.

The illustrated liner top system 300 includes a spring member 348 (for example, one or more compression springs, one or more Belleville washers, one or more piston members) positioned radially around the base pipe 306 within a chamber 350. The spring member 348 is positioned downhole of the wedge 334 and adjacent the shoulder 346 of the wedge 334.

The liner top system 300 also includes a stop ring 352 positioned on an inner radial surface of the bore 308. As illustrated, the stop ring 352 is coupled to or with the base pipe 306 downhole of the inner sleeve 342 and has a diameter less than the bore 308.

FIGS. 4A-4F are schematic diagrams that show an operation of the example implementation of the liner top system of FIGS. 3A-3B. In this example, the operation includes installing the liner 312 in sealing contact with at least a portion of the pack-off element 328, which is, in turn, sealingly engaged with the casing 302 to prevent fluid or debris from circulating downhole between the liner 312 and the casing 302. FIGS. 3A-3B illustrate the liner top system 300 positioned at a location in a wellbore prior to commencement of a liner top operation. Prior operations, such as a cementing operation to cement the casing 302 in place. For instance, prior to a liner top operation, the liner top system 300 may be run into the wellbore to a particular depth. Fluid (for example, water or otherwise) may be circulated to clean the bore 308 and the annulus 304. Next, a spacer and cement may be pumped (for example, per a cementing plan). Next, a dart (for example, wiper dart) may be inserted into the wellbore and the cement may be displaced to secure the casing 302 to a wall of the wellbore. Once the dart lands properly, fluid pressure may be conventionally used to initiate expansion of the liner 312 from a downhole end of the liner 312 to an uphole end of the liner 312. In some cases, however, a pressure leak or other problem may occur causing insufficient expansion (or no expansion) of the liner 312. In such cases, the liner top system 300 may be used to install and seal a top of the liner 312 to the casing 312 with the pack-off element 328. In alternative aspects, the liner top system 300 may be a primary liner installation system in the wellbore.

Figure 4A:
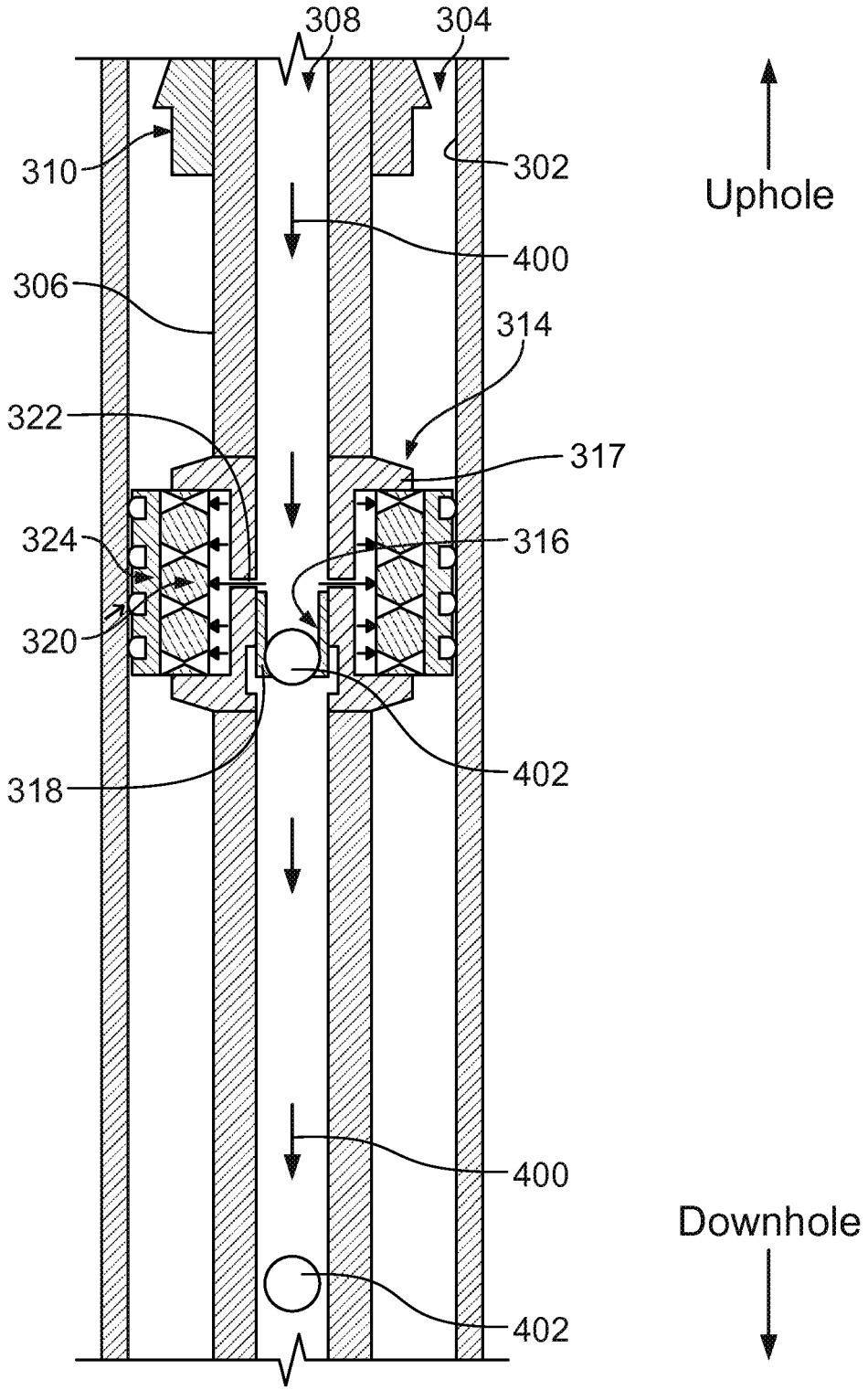
FIGS. 4A-4F are schematic diagrams that show an operation of the example implementation of the liner top system of FIGS. 3A-3B.
Figure 4B:
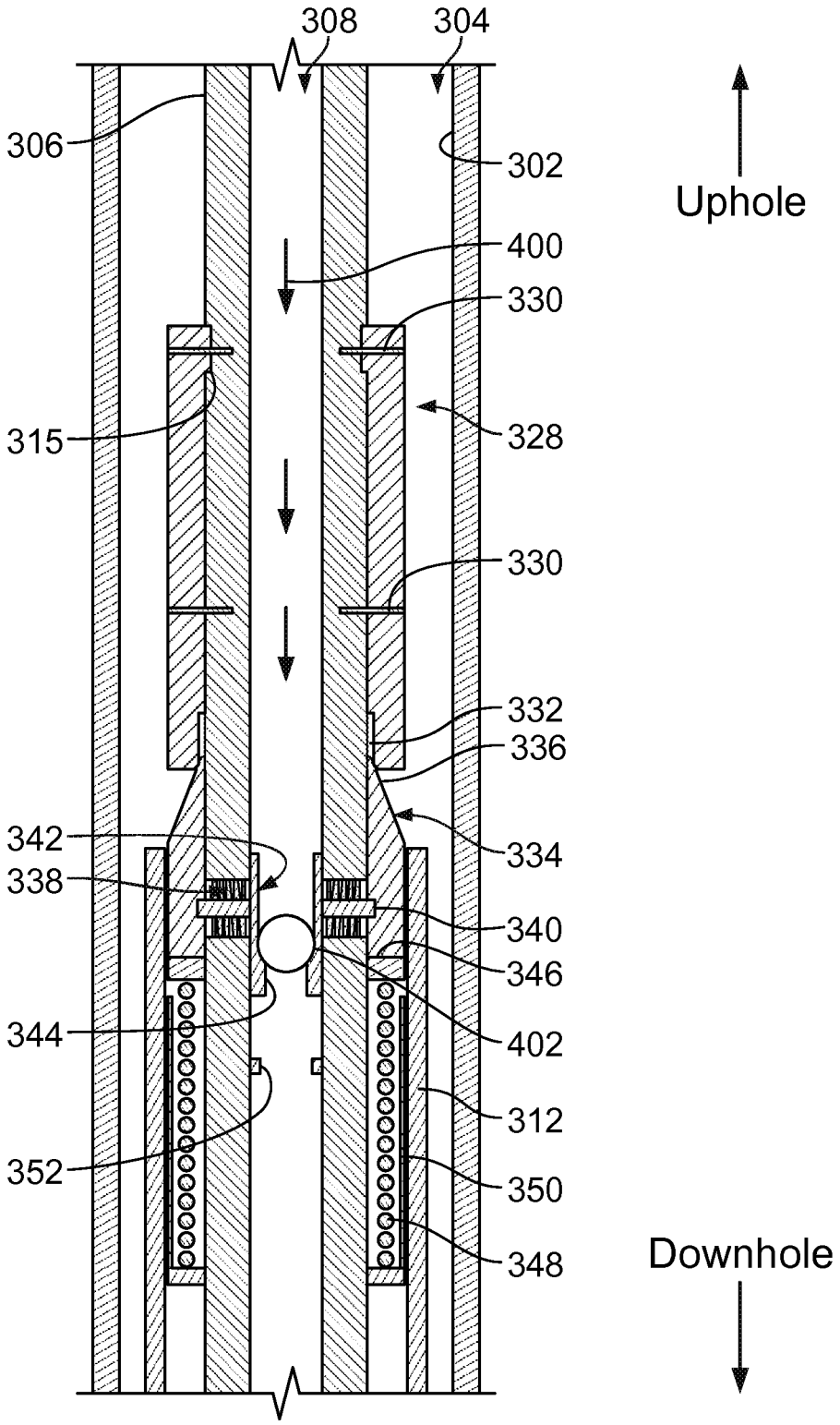

For example, FIGS. 4A-4B illustrates the liner top system 300 pulled uphole so that the pack-off element 328 is uphole of the top of the liner 312. In some aspects, the liner 312 is first decoupled from the cover 310 and then the base pipe 306 is pulled uphole so that the pack-off element 328 is slightly above the top of the liner 312.

Once the base pipe 306 is pulled up so that the pack-off element 328 is above the top of the liner 312, the centralizer 314 may be expanded to center the liner top system 300 in the wellbore. A ball 402 is pumped through the bore 308 by a wellbore fluid 400 until the ball 402 lands on the seat 318. As fluid pressure of the fluid 400 is increased, the ball 402 shifts the sleeve 316 in a downhole direction until the fluid inlets 322 are uncovered.

Once uncovered, continued fluid pressure by the fluid 400 may be applied to the one or more disks 320 through the fluid inlets 322. The one or more disks 320 are then expanded by the fluid pressure to push the bearing surface 324 against the casing 302.

As the fluid pressure radially expands the disks 320 to engage the bearing surface 324 with the casing 302, the base pipe 306 (and components riding on the base pipe 306) is centered in the wellbore. Continued fluid pressure by the fluid 400 may further move the sleeve 316 downhole so that the seat 318 retracts (for example, radially) into the recess 326. As the seat 318 retracts into the recess 326, the ball 402 continues to circulate downhole through the bore 308 until it lands on the seat 344, as shown in FIG. 4B.

Figure 4C:
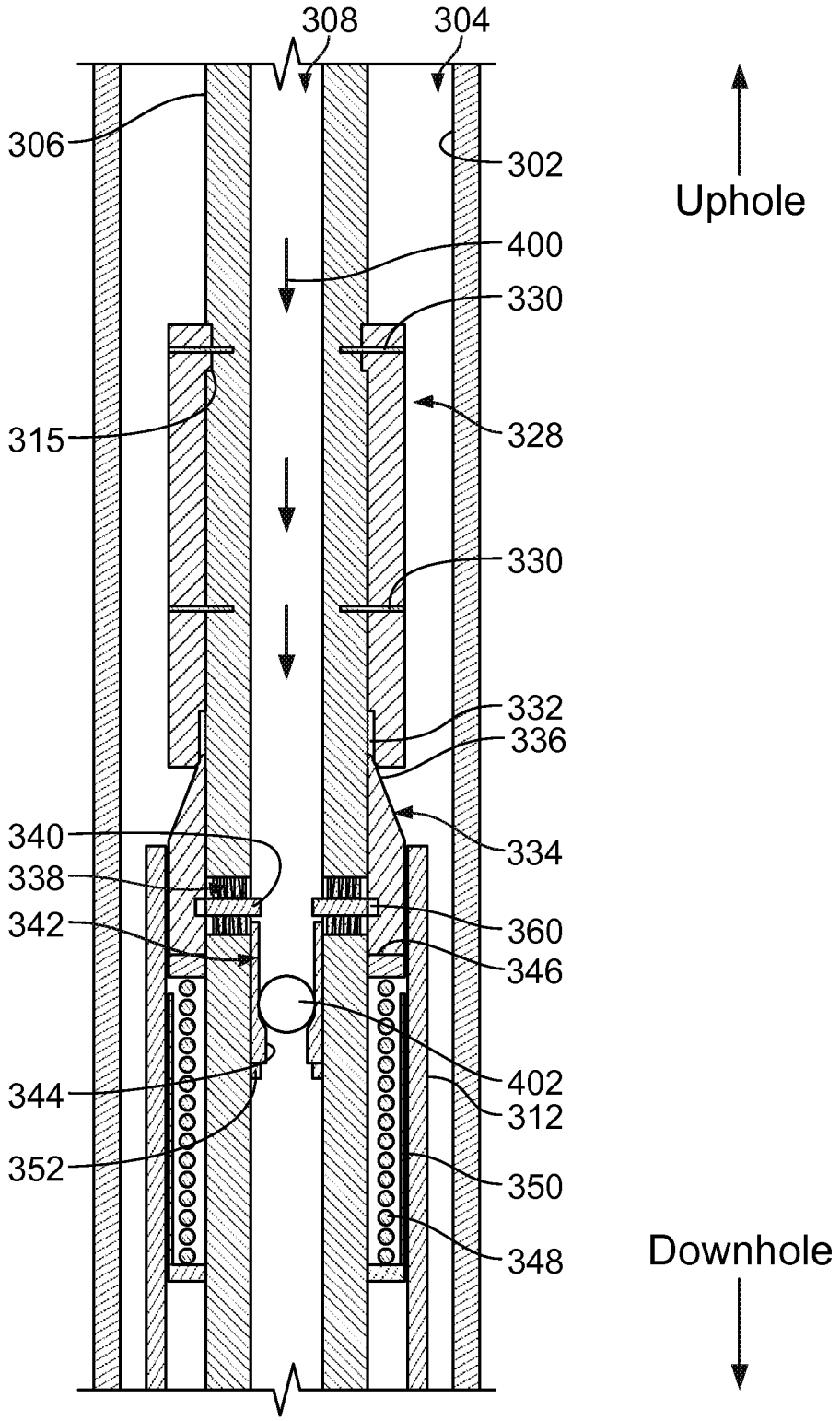

Turning to FIG. 4C, as fluid pressure of the fluid 400 is increased, the ball 402 shifts the sleeve 342 downhole to uncover the locking pins 340. Prior to uncovering, the locking pins 340 couple the wedge 334 to the base pipe 306 by being set in notches 360 formed in the radially inner surface of the wedge 334. As shown in FIG. 4C, once the sleeve 344 moves to uncover the locking pins 340, the biasing member 342 urges the locking pins 340 out of the notches 360 to decouple the wedge 334 from the base pipe 306. As further shown in FIG. 4C, the sleeve 342 may be urged downhole by the pressurized ball 402 until the sleeve 342 abuts the stop ring 352. Once the pack-off element 328 is set at a final position (for example, as shown in FIG. 4F), if desired, increased pressure on the ball 402 may shear the seat 344 and circulate the ball 402 further downhole, thereby facilitating fluid communication through the bore 308 of the liner hanger system 300.

Figure 4D:
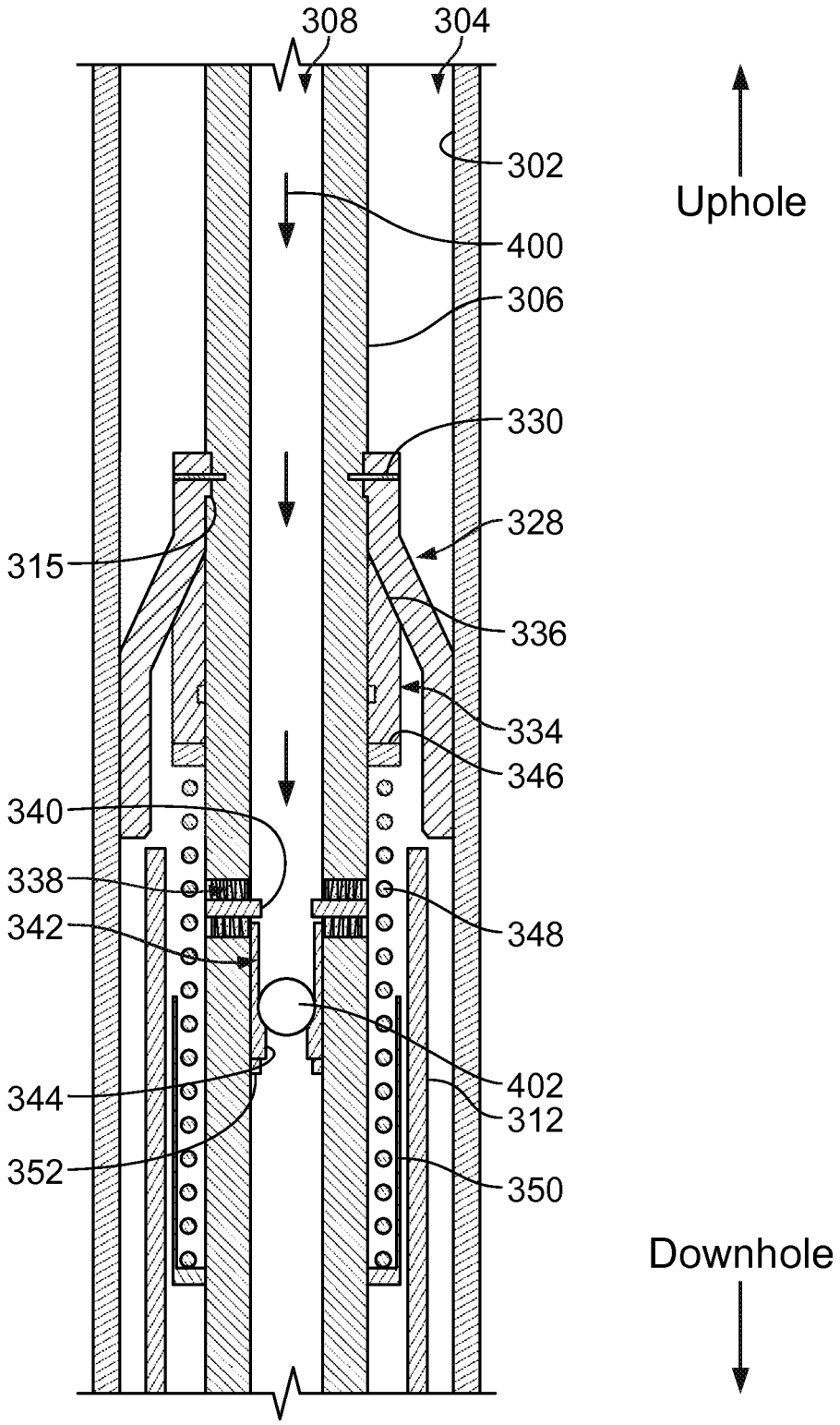

Turning to FIG. 4D, once the wedge 334 is decoupled from the base pipe 306, the wedge 334 is urged uphole by the power spring 348. For example, when constrained in the spring chamber 350 as the shoulder 346 abuts the power spring 348, the power spring 348 may store a significant magnitude of potential energy in compression. Once unconstrained, for example, by decoupling the wedge 334 from the base pipe 306, the potential energy in compression can be released to apply force against the shoulder 346 of the wedge 334 by the power spring 348. The wedge 334 may then be driven uphole toward the pack-off element 328. As the ramp 336 slides under the pack-off element 328 (for example, into the slot 332 of the element 328), the pack-off element 328 expands to engage the casing 302 as shown in FIG. 4D.

Figure 4E:
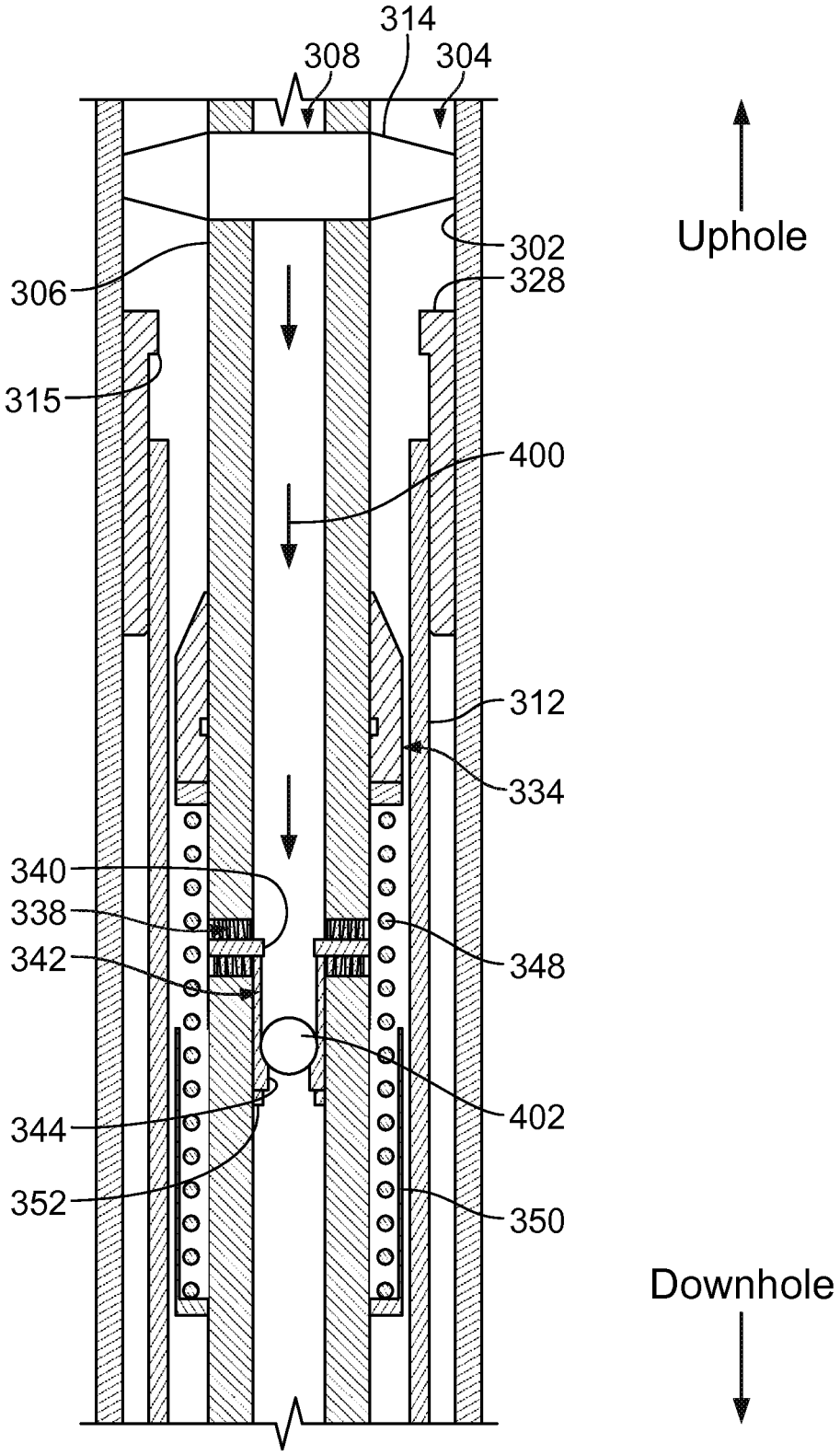
Figure 4F:
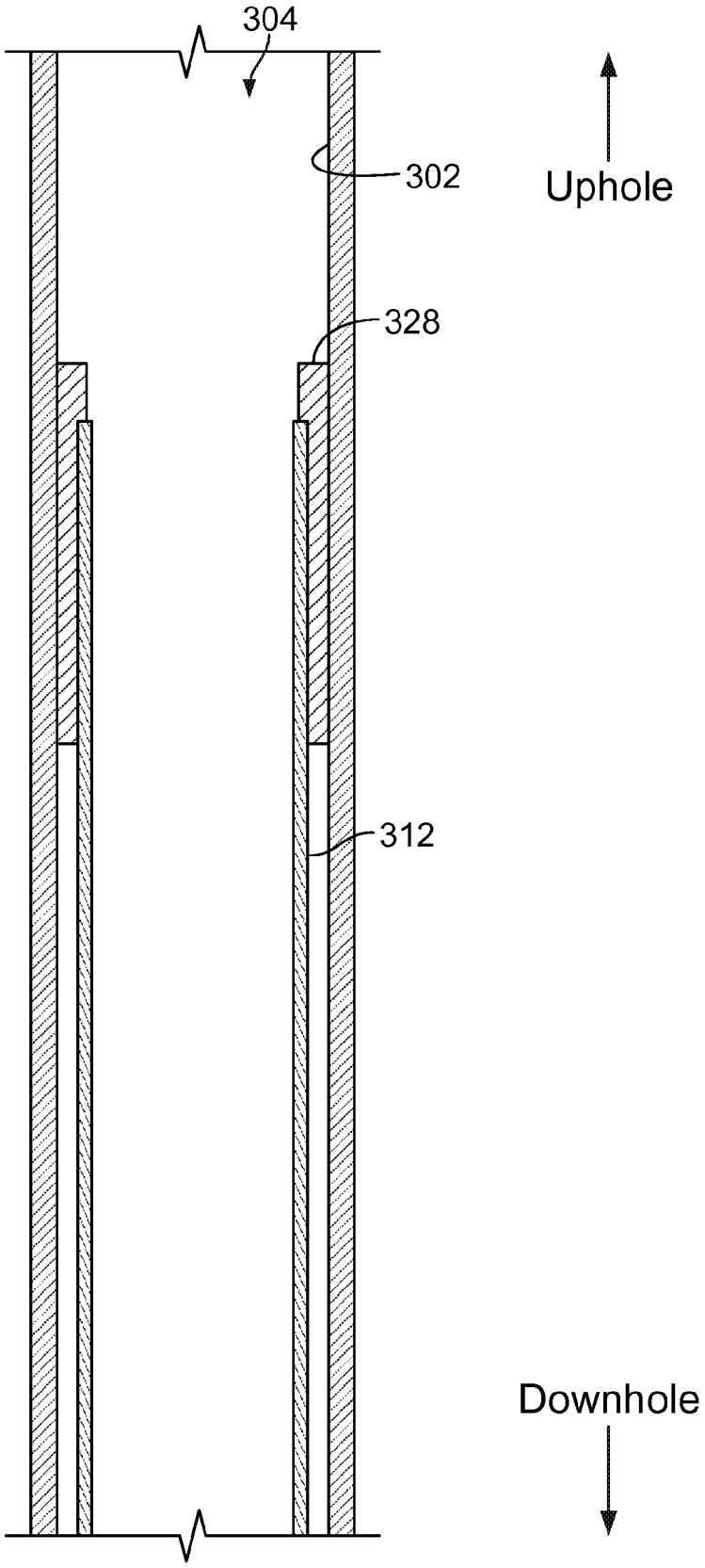

Turning to FIG. 4E, the wedge 334 expands the pack-off element 328 from the base pipe 306 to shear the retaining pins 330, thus allowing the pack-off element 328 to decouple from the base pipe 306. The pack-off element 328 is expanded until it engages the casing 302. Once the pack-off element 328 is engaged to the casing 302 (for example, expanded into plastic deformation against the casing 302), the power spring 348 retracts to a neutral state (for example, neither in compression nor tension).

As shown in FIG. 4E, once the pack-off element 328 is engaged with the casing 302, the centralizer 314 may be moved downhole (for example, on the base pipe 306 to contact a top surface of the expanded pack-off element 328. Once contact is made, the centralizer 314 may be used to push the pack-off element 328 downhole until the element 328 engages a top of the liner 312.

Once engaged with the top of the liner 312, the expanded pack-off element 328 may seal a portion of the wellbore between the liner 312 and the casing 302 so that, for example, no or little fluid may circulate from uphole between the liner 312 and the casing 302. Turning to FIG. 4F, once the pack-off element 328 is expanded to the casing 302 and engaged with the liner 312, the base pipe 306 may be removed from the wellbore, thereby allowing full fluid communication through the wellbore and liner 312.

Figure 5:
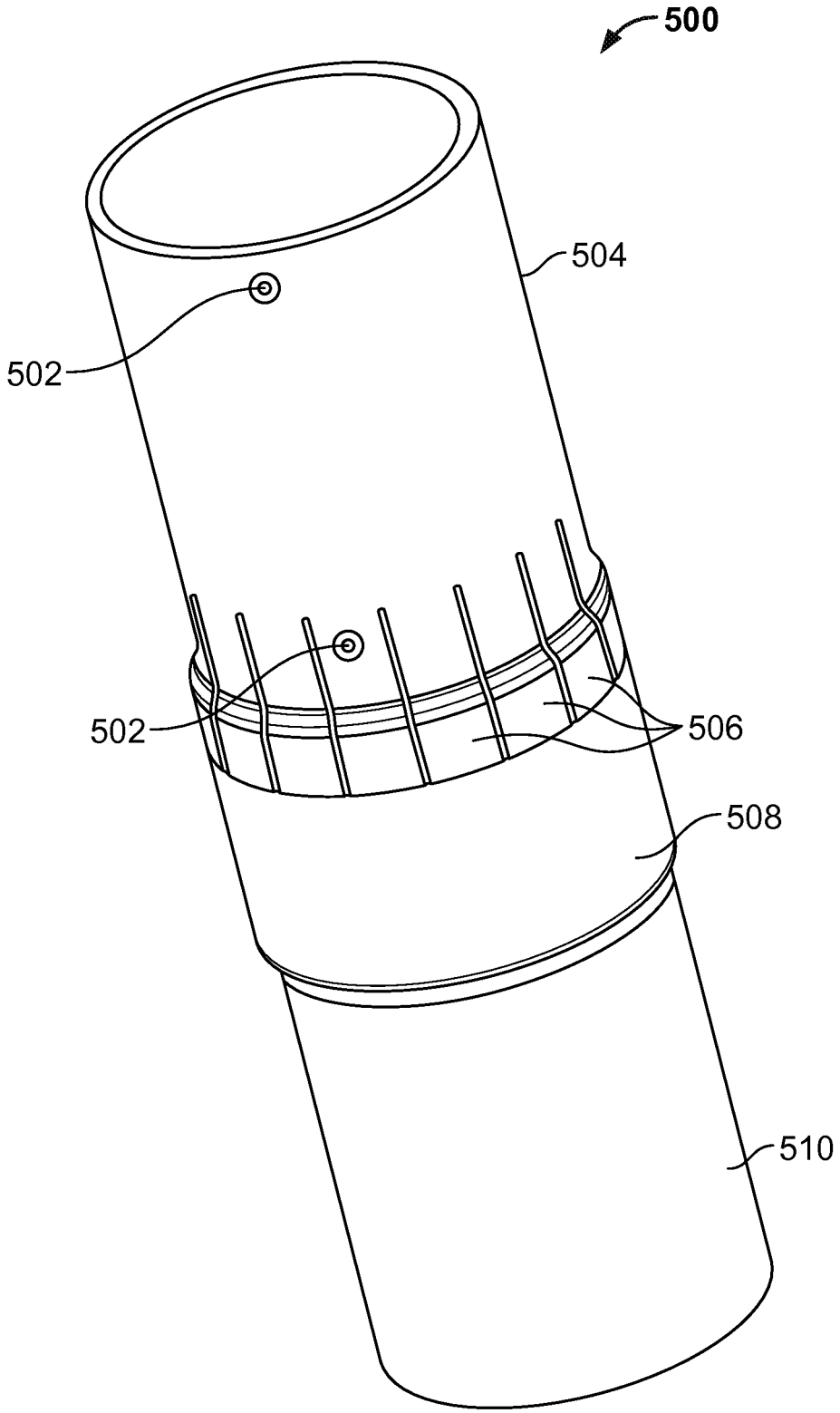
FIG. 5 is an illustration of an example pack-off element for a liner top system.

FIG. 5 is an illustration of an example pack-off element 500 for a liner top system. In some implementations, the pack-off element 500 may be used in the liner top system 300. As illustrated in this example implementation, the pack-off element 500 includes a tubular 504 that includes retaining pins 502 and slotted fingers 506 that extend radially around the tubular 504. The tubular also includes a solid wedge cone 508 at a bottom end of the tubular 504. As shown in FIG. 5, the pack-off element 500 can ride on a base pipe 510.

In operation, as described more fully with respect to FIG. 4A-4F, a wedge may ride on the base pipe 510 and urged under the solid wedge cone 508 (for example, by a biasing member). As the wedge expands the solid wedge cone 508, the slotted fingers 506 are expanded radially outward to engage a casing or wellbore wall.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A downhole tool system, comprising:

a base tubular that comprises a bore therethrough;

a centralizer positioned to ride on the base tubular, the centralizer expandable to contact a wellbore wall and adjust a location of the downhole tool system relative to the wellbore wall based on a first fluid pressure supplied through the bore; and a liner top assembly positioned to ride on the base tubular, the liner top assembly comprising a wellbore liner and a pack-off element, the pack-off element expandable to at least partially seal a liner top of the wellbore liner to the wellbore wall based on a second fluid pressure supplied through the bore, wherein the centralizer further comprises a first seat to receive a member circulated through the bore to expose the centralizer to the first fluid pressure, and the liner top assembly further comprises a second seat to receive the member circulated through the bore to expose the liner top assembly to the second fluid pressure.

2. The downhole tool system of claim 1, wherein the liner top assembly further comprises a wedge positioned to ride on the base tubular and expand the pack-off element to at least partially seal the liner top to the wellbore wall based on the second fluid pressure supplied through the bore.

3. The downhole tool system of claim 2, wherein the wedge is coupled to the base tubular with at least one pin member.

4. The downhole tool system of claim 3, wherein the pin member is positioned to release the wedge from the base tubular based on the second fluid pressure supplied through the bore.

5. The downhole tool system of claim 3, wherein the liner top assembly further comprises a sliding sleeve positioned within the bore and adjustable, based on the second fluid pressure, to release the pin member and decouple the wedge from the base tubular.

6. The downhole tool system of claim 2, wherein the liner top assembly further comprises a biasing member positioned to abut the wedge and drive the wedge to expand the pack-off element to at least partially seal the liner top to the wellbore wall based on the second fluid pressure supplied through the bore.

7. The downhole tool system of claim 1, wherein the centralizer comprises:

an inner sleeve positioned within the bore and adjustable, based on the first fluid pressure, to expose a fluid inlet to the bore; and a fluidly expandable member in fluid communication with the fluid inlet to expand based on the first fluid pressure communicated through the fluid inlet.

8. The downhole tool system of claim 1, wherein the centralizer further comprises a bearing surface coupled with the fluidly expandable member to engage the wellbore wall based on the first fluid pressure.

9. The downhole tool system of claim 1, wherein the first and second fluid pressures comprise different magnitudes.

10. The downhole tool system of claim 1, wherein the wellbore wall comprises a wellbore casing.

11. A method for sealing a liner top to a wellbore wall, comprising:

circulating a fluid through a bore of a tubular positioned in a wellbore;

circulating the fluid at a first fluid pressure to the centralizer positioned on the tubular, wherein the circulating comprises:

receiving a ball dropped through the wellbore at a seat of a sleeve of the centralizer to create a fluid seal at the seat of the sleeve of the centralizer; and adjusting a pressure of the fluid uphole of the ball to the first fluid pressure;

expanding, with the fluid at the first fluid pressure, the centralizer expandable to contact a wellbore wall of the wellbore to adjust a location of the tubular relative to the wellbore wall;

adjusting the fluid to a second fluid pressure in the wellbore, wherein the adjusting comprises:

receiving the ball dropped through the wellbore at a seat of a sleeve of a pack-off element of a liner top assembly to create a fluid seal at the seat of the sleeve of the pack-off element; and adjusting the pressure of the fluid uphole of the ball to the second fluid pressure;

expanding, with the fluid at the second fluid pressure, the pack-off element of the liner top assembly positioned on the base tubular to engage the wellbore wall; and sealing a wellbore liner top to the wellbore wall with the expanded pack-off element.

12. The method of claim 11, further comprising:

subsequent to sealing the wellbore liner top to the wellbore wall with the expanded pack-off element, removing the tubular with the centralizer and the liner top assembly from the wellbore.

13. The method of claim 11, wherein expanding the centralizer comprises:

adjusting the sleeve of the centralizer that is positioned within the bore to expose a fluid path to the bore;

exposing an expandable member to the first fluid pressure in the fluid path;

radially expanding the expandable member with the first fluid pressure;

adjusting, with the expanded member, a bearing surface of the centralizer to contact the wellbore wall; and adjusting the location of the tubular relative to the wellbore wall.

14. The method of claim 11, wherein expanding the pack-off element comprises:

releasing, with the fluid at the second fluid pressure, a wedge positioned on the tubular adjacent the pack-off element from the tubular.

15. The method of claim 14, wherein releasing the wedge comprises adjusting the sleeve of the pack-off element with the second fluid pressure to release a pin member that couples the wedge to the tubular.

16. The method of claim 14, further comprising urging the released wedge toward the pack-off element to expand the pack-off element to at least partially seal the wellbore liner top to the wellbore wall with the pack-off element.

17. The method of claim 11, wherein the first and second fluid pressures comprise different magnitudes.

18. The method of claim 11, wherein the wellbore wall comprises a wellbore casing.

* * * * *